US005453035A

United States Patent [19]

Jenkins

[11] Patent Number: 5,453,035

[45] Date of Patent: Sep. 26, 1995

[54] APPARATUS AND METHOD OF REMOTELY RETRIEVING A RADIO-CONTROLLED MODEL

[76] Inventor: Jimmy R. Jenkins, 12150 Shiloh Rd. #120, Dallas, Tex. 75228

[21] Appl. No.: 130,270

[22] Filed: Oct. 1, 1993

[51] Int. Cl.[6] ..... A63H 23/04; A63H 29/24; B63H 23/10

[52] U.S. Cl. ..... 446/163; 446/154; 446/165; 446/453; 440/4

[58] Field of Search ..... 446/154, 160, 446/162–165, 443, 456, 463, 57, 58; 440/75, 78, 4, 6

[56] References Cited

U.S. PATENT DOCUMENTS

| | | | |
|---|---|---|---|
| 474,926 | 5/1892 | Regan | 440/75 |
| 2,492,215 | 12/1949 | Greenberg | 446/165 |
| 3,170,434 | 2/1965 | Ewing | 440/4 |
| 4,161,077 | 7/1979 | Ciaccio et al. | 446/154 X |
| 4,273,543 | 6/1981 | McCusker | 440/4 |
| 4,378,219 | 3/1983 | Tamaka | 440/75 |
| 4,568,289 | 2/1986 | Heidrich et al. | 440/4 X |
| 4,614,900 | 9/1986 | Young | 440/6 |

OTHER PUBLICATIONS

American Modeler "Starting R/C Model Boating", vol. 52, No. 6, Sep. 1959 pp. 26, 27, 60.

*Primary Examiner*—Danton D. DeMille
*Attorney, Agent, or Firm*—T. D. Copeland

[57] ABSTRACT

An apparatus and method of retrieving a radio-controlled fuel-powered model boat is disclosed. The apparatus includes a pivot arm, with a pinion gear and an idler gear, that is attached to the shaft of a secondary motor. The idler gear in said pivot arm engages a driven gear that turns the model boat's propeller shaft by transferring the secondary motor shaft's rotation through gears to the propeller shaft. The apparatus includes a movement limiting bracket that limits the pivot arm's movement to either engage or disengage the driven gear attached to the model boat's propeller drive shaft.

4 Claims, 3 Drawing Sheets

APPARATUS AND METHOD OF REMOTELY RETRIEVING A RADIO-CONTROLLED MODEL

BACKGROUND OF THE INVENTION

1. Field of the Invention

The invention relates broadly to the field of remote controlled models. More particular, but not by way of limitation, the invention relates to secondary propulsion apparatus that enables an operator to remotely retrieve a power driven radio-controlled model after the model's fuel is exhausted.

2. Summary of Prior Art

In the past, operators had to walk and wade or swim to retrieve their fuel-powered model boats after its fuel was exhausted. Nothing detracts more from the pleasure of operating a radio-controlled model boat than having to wade to retrieve it because of the time, effort and inconvenience entailed with this necessary action.

In a typical use of a radio-controlled model such as racing, walking and wading or swimming to retrieve an inert model could also be embarrassing or unsafe. During a model racing match (informal or formal) a competitor is deemed to know the limits of his model. The applicable characteristic limits include the model's range, weight and maximum speed, all of which factor into the model's rate of fuel consumption. When a model has run out of fuel, it is obvious that its operator pressed the model beyond its limits and his careful concern, subjecting the operator to possible jeering by his peers. Already embarrassed by the situation, insult is added to injury when the operator must retrieve his now inert model by walking and wading or swimming while his peers jestingly cheer him on.

Safety also becomes a factor because a multi-vehicle race might not be halted while the operator retrieves his particular model. In this situation, potential injury to the operator might occur as he makes his way across the race's path. Another hazard to considers is that before the model can be retrieved, the stranded model creates an obstruction that threatens other competitor's models by a collision and vice versa. However, if the operator is able to remotely remove or retrieve his model, the improvement in speed and ease allows quicker retrieval of the model, creating less time for the obstruction to exist, and thus limiting the exposure to harm of his and other vehicles, as well as to the operator himself.

The present invention fills a long felt need for a method and system that will easily, effectively, and safely allow an operator to retrieve his model. The present invention provides a means to allow retrieval using the standard two-channel transmission system, and without affecting the performance of the remote-controlled model, thereby effectively eliminating the inconvenience and hazards associated with the prior methods of retrieval.

SUMMARY OF THE INVENTION

The present invention provides both an apparatus and a method to activate and employ secondary propulsion apparatus to allow an operator to remotely retrieve his radio-controlled model in the event the model becomes inert either through mechanical failure of its primary propulsion means or exhaustion of its fuel or energy supply.

A principal object of this invention is to provide a secondary propulsion means for radio-controlled models that is integral to the present design of the model, and utilizes the radio signal-generating apparatus already present in the model's control system.

A further object of this invention is to provide a radio-controlled retrieval system that provides alternative propulsion means to run the model when the principal propulsion means is no longer available.

Yet another object of this invention is to provide a radio-controlled electric power system that engages the principal power drive mechanism to continue operation when the fuel supply of the principal power source is exhausted.

An additional object is to provide a radio controlled system and method for engaging and driving the propeller shaft of a stranded model boat for retrieval purposes when the boat's regular fuel supply is exhausted.

DESCRIPTION OF THE PREFERRED EMBODIMENT

In fuel-engine powered model situations, an operator finds it desirable to remotely retrieve his model via its own power rather than retrieve it by manual means. For simplicity of presentation, it will be noted that this description is within the context of radio-controlled model boats, but that the invention has utility in all fields of radio-controlled models.

Figure 6:
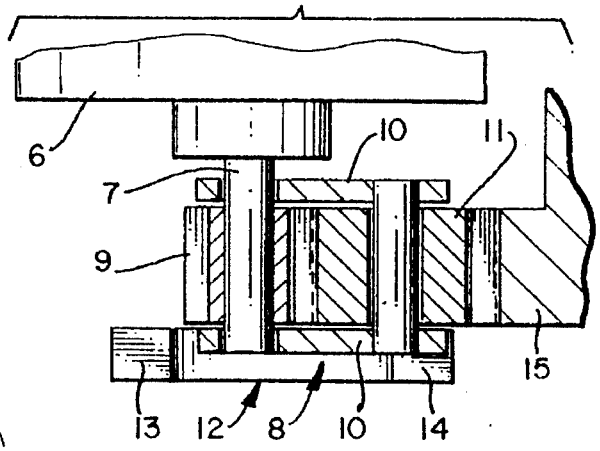
FIG. 6 is a sectional view of the system and elements taken along the lines 6—6 of FIG. 5; and FIGS. *7a* and *7b* are plan views of the return spring that may be alternatively used to disengage the secondary drive.
Figure 1:
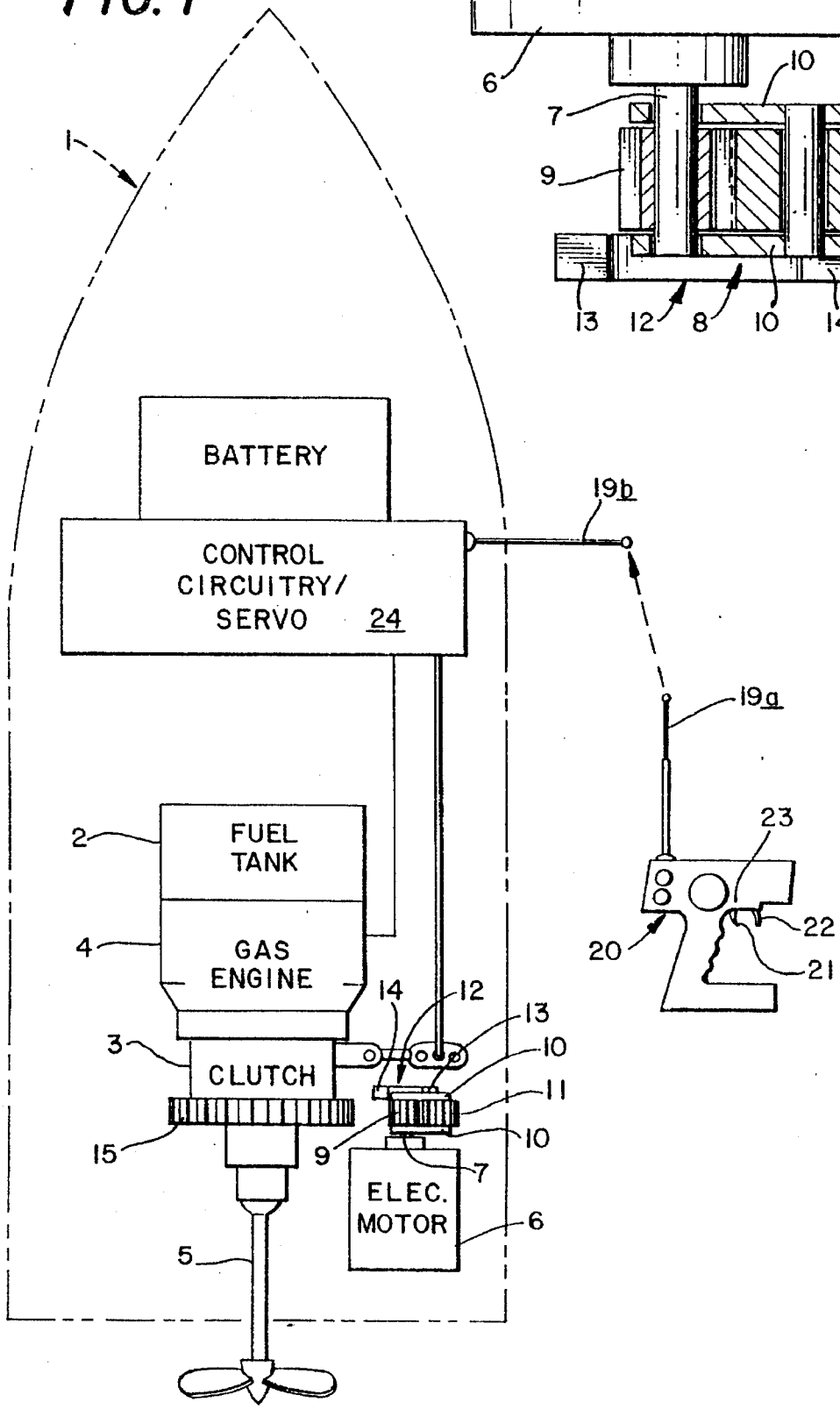
FIG. 1 is a top plan view of this invention in outline schematic form installed on, and utilized with a gasoline driven model boat.
Figure 2:
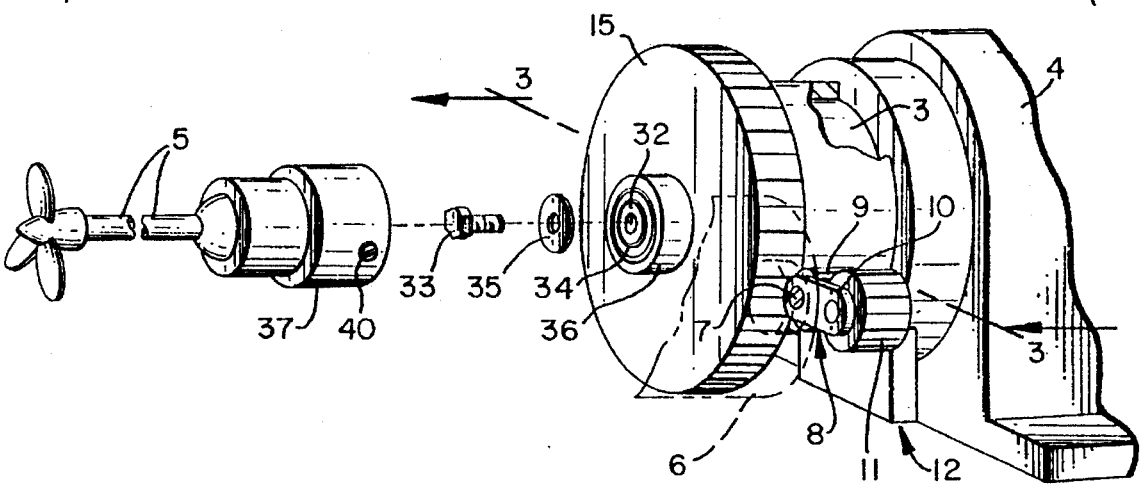
FIG. 2 is a perspective view of the system and elements of the present invention.

Referring now more particularly to the figure numbers on the drawing, it will be seen in FIG. 1 that when the fuel in fuel tank 2 is depleted or its primary engine 4 fails, the preferred embodiment of which consists of a gas engine, the radio-controlled model boat 1 becomes dead-in-the-water. Once model boat 1 stops operating, primary engine 4 is disengaged from primary drive shaft 5 by clutch 3, the preferred embodiment of which is a centrifugal clutch.

Figure 3:
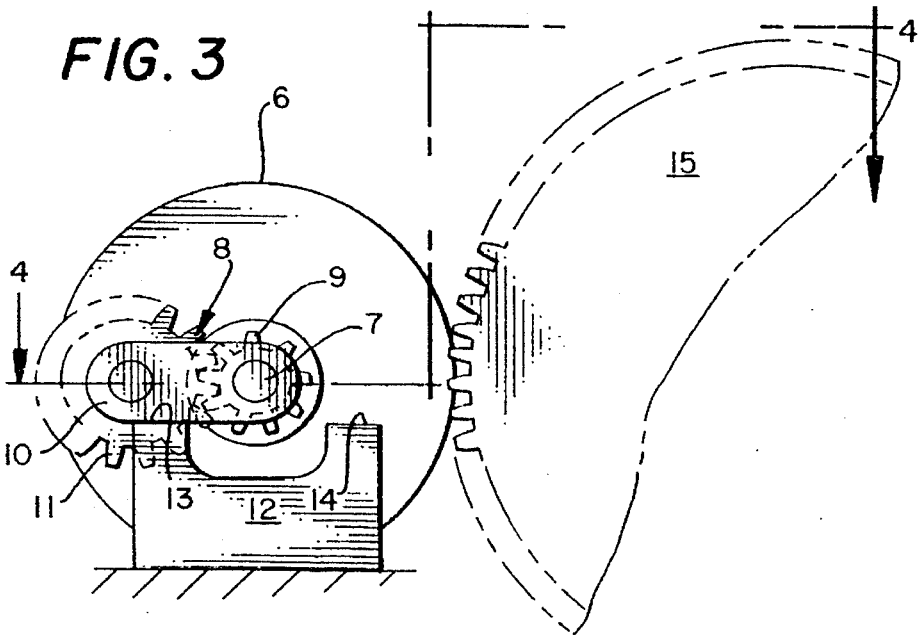
FIG. 3 is a frontal view of the system and elements showing the present invention in a disengaged configuration.

Referring now to the character reference in FIG. 3, the invention includes a pivot arm 8 that contains an idler gear 11 driven by pinion gear 9 between two side plates 10 of the pivot arm 8. After clutch 3 has disengaged primary engine 4 from primary drive shaft 5 (which occurs automatically when engine 4 ceases to function via clutch 3), pivot arm 8, comprising pinion gear 9 and idler gear 11, passes on the rotational energy from secondary motor 6 to drive driven gear 15. Driven gear 15 may be mounted about primary drive shaft 5 either by being pressed onto the centrifugal clutch 3, or by being integrally incorporated with clutch's housing (not shown in the drawings). Thus attached to the primary drive shaft 5, driven gear 15, as powered by idler gear 11, continuously rotates the primary drive shaft 5 so that model boat 1 receives its locomotion from the secondary power source, and may be remotely controlled and retrieved.

Figure 4:
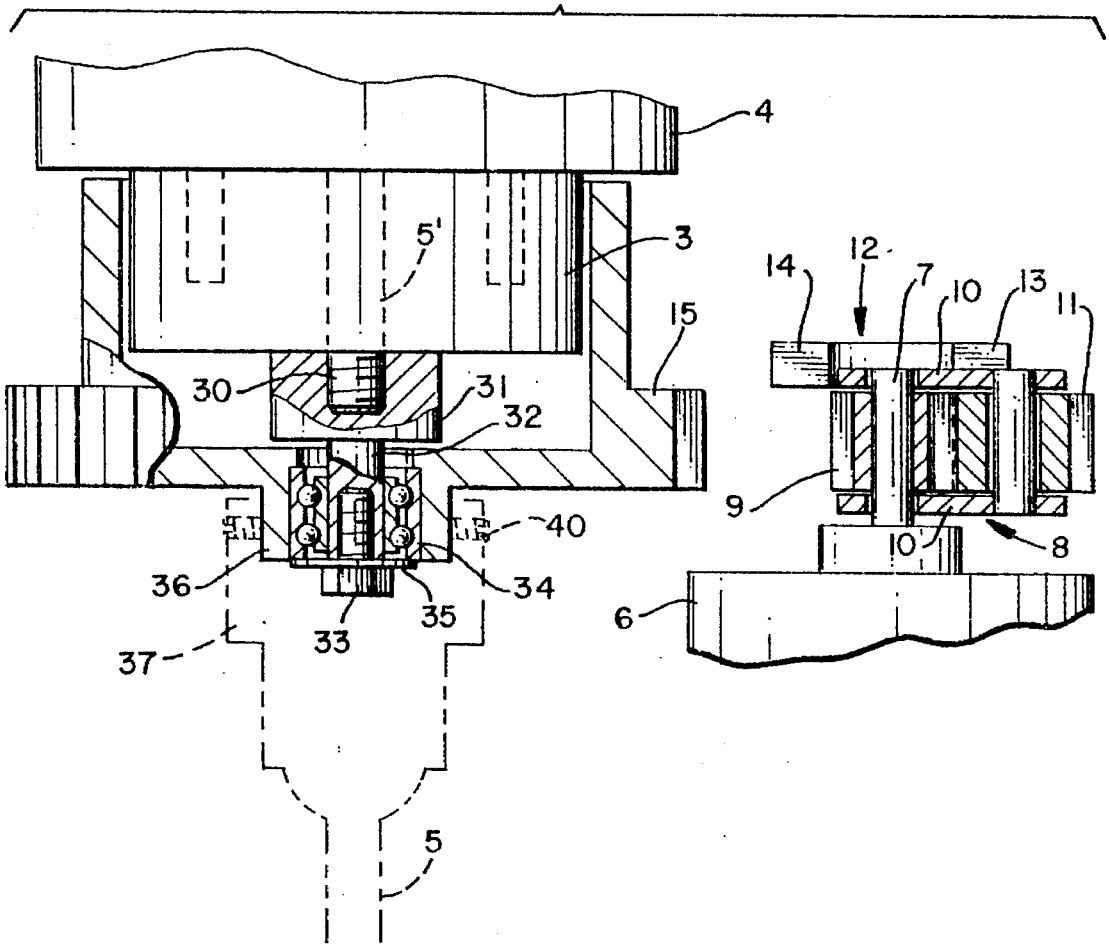
FIG. 4 is a sectional view of the system and elements taken along the lines 4—4 of FIG. 3.

Referring now to the character reference in FIG. 4, pivot arm 8 is comprised of two side plates 10 that define shaft receiving holes for gears. Pinion gear 9 and idler gear 11 are floatingly mounted between two side plates 10. Pinion gear 9 is mounted in a first end of side plates 10, and idler gear 11 is mounted in a second end of side plates 10. Idler gear 11 and pinion gear 9 are mounted such that each gear intermeshes with the other. In turn, idler gear 11 may be remotely positioned to intermesh with driven gear 15 and convey the power from pinon gear 9 as it is rotated by secondary motor shaft 7 of secondary motor 6.

A movement limiting bracket 12 includes movement limiting stops 13 and 14 to limit the movement of side plates 10 of pivot arm 8 to a forward or engage position or a rearward or disengage positions, respectively. The first end of pivot arm 8 containing pinion gear 9 is installed over secondary motor shaft 7 so that shaft 7 rotates freely within side plates 10 of pivot arm 8. Pinion gear 9 is affixed to and rotates with secondary motor shaft 7.

Figure 7A:
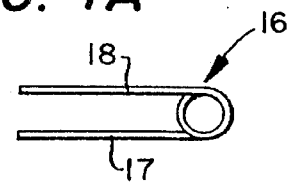
Figure 7B:
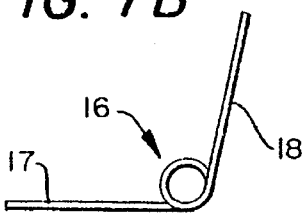

Once the boat is retrieved and secondary motor 6 is deactivated, pivot arm 8 may be returned to its disengage position at movement limiting stop 13 through reinitialization means, comprising a torsion or loop spring 16 (shown in FIG. 7(*a*) retracted and (b) extended) having a first end 17 attached to movement limiting stop 13 and a second end 18 attached to a side plate 10 near idler gear 11. Generally, the torque, in the opposite direction, created by the powering down of the secondary motor 6 is generally sufficient to return pivot arm 8 to movement limiting stop 13.

OPERATION OF THE PREFERRED EMBODIMENT

In FIG. 1, when the boat is in operation using its primary power means 4, servo control trigger 21, shown in its neutral position 23, is squeezed to send a radio frequency signal from antenna 19*a* of transmitter 20 to the antenna 19*b* of the servo control circuitry 24 (comprising signal processing electronics and servos for speed and direction control) on model boat 1, causing boat 1 to go forward due to the circuitry in unit 24. In the event the model's primary engine 4 runs out of fuel or malfunctions, the operator may transmit a signal through transmitter 20, via the reverse position 22 of the model's servo control trigger 21, through antenna 19*a* and 19*b*, for control circuitry 24 to activate secondary motor 6. Power to the primary drive shaft 5, from secondary motor 6, is activated after centrifugal clutch 3 disengages the gas-powered engine 4 from primary drive shaft 5, which happens automatically when the model's gas-powered engine 4 becomes inoperative. Thereafter, the secondary motor 6 acquires control of and supplies power to the model's primary drive shaft 5.

Figure 5:
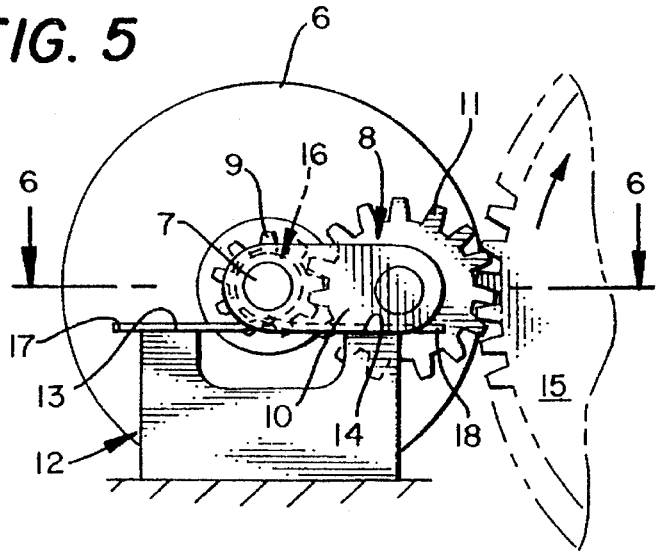
FIG. 5 is a frontal view of the system and elements showing the present invention in an engaged configuration.

In FIG. 5, after secondary motor 6 is activated, pivot arm 8 (affixed to the secondary motor shaft 7) rotates about secondary motor shaft 7 until the idler gear 11 engages the driven gear 15 at the movement limiting stop 13, as defined by movement limiting bracket 12. Rotation emanating from the electric motor 6 is then transferred to the driven gear 15 via pinion gear 9 and idler gear 11. Operatively mounted about the primary drive shaft 5, driven gear 15 transfers power from secondary motor 6 to primary drive shaft 5. Thus powered, locomotion is provided, allowing the operator to remotely control, power and retrieve his model boat 1.

When the model boat 1 has returned to shore, and the secondary power source 6 turned off, spring 16 will normally return the arm 8 and gear 11 to its discharge position. In the event spring 16 becomes broken, or is not in use, the next start up of the primary power source 4, will automatically kick gear 11 and arm 8 to disengaged position 13.

In FIG. 4, it will be seen that the output drive shaft 5 from the gasoline powered engine 4 passes through the centrifugal clutch 3 and its threaded end 30 terminates in a large hex nut 31 that has an extension shaft 32 that is engaged in a holding relation with threaded bolt 33 and bearings 34 and washer 35 in the raised boss 36 of driven gear 15. The propeller drive shaft 5 includes an open end cup member 37 that engages boss 36 by press fitting these two members together, or attached with set screws 40, as shown in FIG. 4. When the primary power source of the gas engine 4 ceases to operate, the centrifugal clutch 3 will contract as shown in FIG. 4, and the drive gear 15 is engaged by servo signal through the secondary power source of the battery operated electric motor 6, through the agency of its pinion drive gear 9, and idler gear 11 to supply the locomotion power necessary to bring the stranded boat 1 back to shore. When the motor 6 is turned off, and there is no longer any driving torque supplied to maintain the gears 9 and 11 in driving position, so that the gas engine 4 will once again be able to supply the full driving power to the boat.

Thus, it is apparent that the apparatus of the present invention readily achieves the advantages mentioned as well as those inherent therein. While certain preferred embodiments of the invention have been illustrated for the purpose of this disclosure, numerous changes in the arrangement and construction of parts may be made by those skilled in the art, which changes are embodied within the scope and spirit of the present invention as defined by the appended claims.

What is claimed is:

1. A method of remotely retrieving a radio-controlled vehicle with a powered primary output drive shaft, comprising in combination the steps of:

activating a secondary locomotion means having a secondary drive shaft located on said radio controlled vehicle, and transferring power from said secondary drive shaft to said primary output drive shaft from a location remote from said vehicle through servo controls activated by radio control means both on and off said vehicle for providing locomotion for said vehicle, when the power source for said primary output drive shaft is inoperative;

and wherein the second step above comprises rotating a pivot arm containing gear means mounted on said secondary drive shaft to a position of engagement of said gear means with a driven gear functionally mounted on said primary output shaft.

2. The method of claim 1, wherein the second step further comprises:

rotating a pinion gear within said pivot arm, wherein said secondary power drive shaft rotates said pinion gear, rotating an idler gear within said pivot arm wherein said pinion gear rotates said idler gear, and rotating said driven gear operatively mounted about said primary output shaft wherein said idler gear rotates said driven gear.

3. A system for remotely retrieving a radio-controlled fuel powered model boat with a primary fuel powered drive and propeller drive disengaging means, comprising:

separately powered secondary drive means with a secondary drive shaft for powering said model boat in the event said primary fuel powered drive ceases to operate, servo means for activating said secondary drive means from a remote location, and gear drive means to propel said vehicle when said secondary drive means is activated, a pivot arm operatively mounted on said secondary drive shaft, a driven gear operatively mounted about said primary output drive shaft, and a movement limiting bracket defining a disengage position and an engaging position, wherein upon activation of said secondary drive shaft, said pivot arm travels from said disengage position to said engage position to engage said gear drive means for powering said primary output drive shaft.

4. The pivot arm as in claim 3 comprising:

a first side plate adjacent said secondary drive means, a second side plate, each side plate having a first shaft receiving hole at a first end and a second shaft receiving hole at a second end, a pinion gear with a shaft, and an idler gear with a shaft, and wherein said side plates encase said pinion gear and its shaft at said first end, and said side plates encase said idler gear and its shaft at said second end.

* * * * *